United States Patent [19]

Hamilton

[11] 4,288,124

[45] Sep. 8, 1981

[54] WHEELCHAIR-CARRIED TRANSFER STOOL

[76] Inventor: Rex Hamilton, 2701 S. Watson, Visalia, Calif. 93277

[21] Appl. No.: 80,580

[22] Filed: Oct. 1, 1979

[51] Int. Cl.[3] ..... A47C 13/00

[52] U.S. Cl. ..... 297/217; 297/233; 297/DIG. 4; 5/81 R

[58] Field of Search ..... 297/DIG. 4, 115, 43, 297/217, 233; 5/81 R

[56] References Cited

U.S. PATENT DOCUMENTS

| | | | |
|---|---|---|---|
| 1,347,549 | 7/1920 | Mote | 5/81 R |
| 2,596,055 | 5/1952 | Thomas | 297/5 X |
| 2,792,874 | 5/1957 | Sundberg | 297/DIG. 4 |
| 2,913,732 | 11/1959 | Jones | 297/DIG. 4 |
| 3,123,397 | 3/1964 | Murcott | 297/DIG. 4 |
| 3,138,805 | 6/1964 | Piazza | 297/DIG. 4 |
| 3,398,974 | 8/1968 | Edwards . | |
| 3,405,954 | 10/1968 | Wolfe | 297/5 X |
| 3,584,890 | 6/1971 | Presty | 297/5 X |
| 3,719,390 | 1/1971 | Haney | 297/DIG. 4 |
| 3,758,894 | 9/1973 | Finley | 5/81 R |
| 3,999,778 | 12/1976 | Markiel | 297/5 X |
| 4,082,348 | 4/1978 | Haury | 297/DIG. 4 |
| 4,098,521 | 7/1978 | Ferguson et al. | 297/DIG. 4 |
| 4,101,143 | 7/1978 | Sieber | 297/DIG. 4 |
| 4,113,307 | 9/1978 | Day | 297/DIG. 4 |
| 4,155,588 | 5/1979 | Dauziger | 5/81 R |
| 4,193,147 | 3/1980 | Fischer | 297/DIG. 4 |

*Primary Examiner*—Francis K. Zugel

*Attorney, Agent, or Firm*—Manfred M. Warren; Robert B. Chickering; Glen R. Grunewald

[57] ABSTRACT

A transfer stool for use with and carrying by a wheelchair is disclosed. The transfer stool includes a relatively narrow seat, a plurality of legs foldably secured to the seat for movement to and from a collapsed condition and an extended condition, wheels rotatably mounted to the legs, and a mounting structure for carrying of the transfer stool by the wheelchair in a collapsed condition, preferably in the same location as the conventional armrest structure of the wheelchair. In order to deploy the stool, the user slides the collapsed transfer stool forwardly from its stored position along the side of the chair, rotates the stool to a horizontal position, and extends the legs of the stool. The user can then shift from the chair to the stool, raise the folding back of the stool and move the stool independently of the chair to afford access to areas having relatively narrow passageways that would not accommodate a conventional wheelchair.

13 Claims, 7 Drawing Figures

Fig. 4
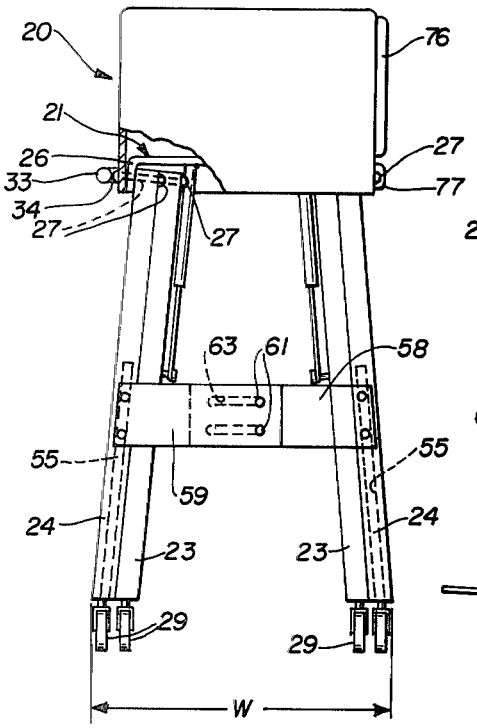
Fig. 5
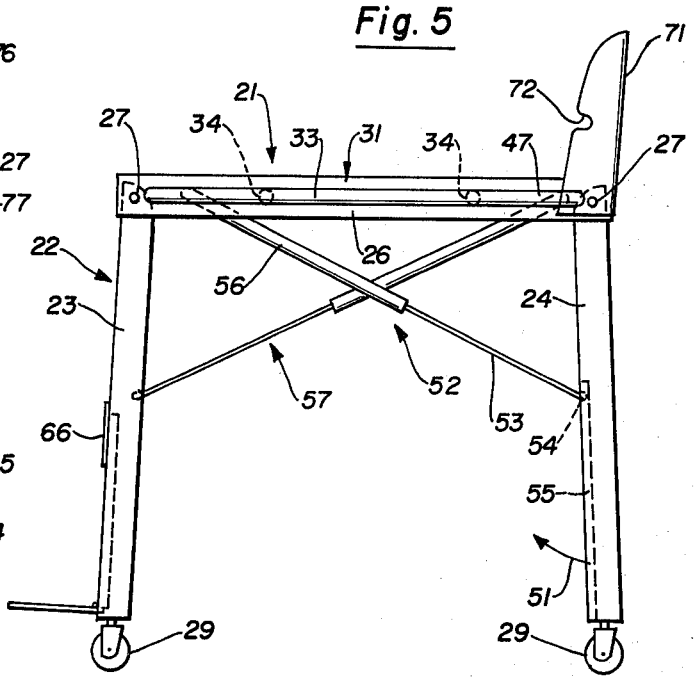
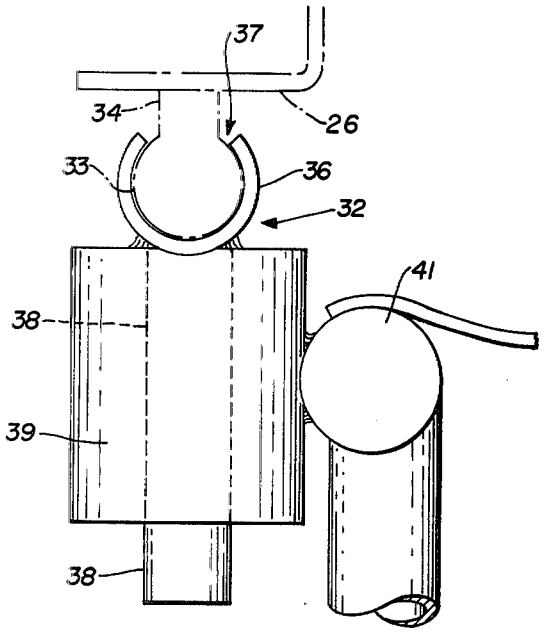
Fig. 6
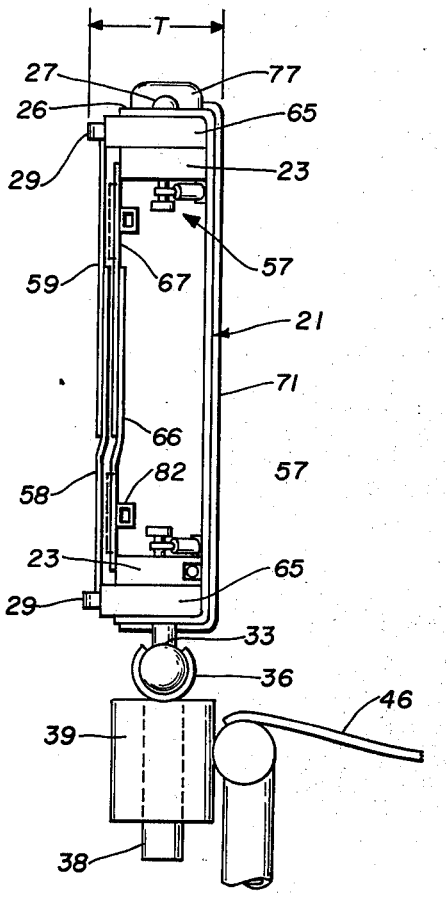
Fig. 7

WHEELCHAIR-CARRIED TRANSFER STOOL

BACKGROUND OF THE INVENTION

One problem which is commonly encountered by disabled persons who must rely on wheelchairs for their mobility is that conventional wheelchairs are relatively wide and cannot conveniently pass through many openings or passageways. Thus, the doors on some bathrooms, the aisles in airplanes and theaters, and other halls and doorways can present a barrier which will restrict passage by those who must depend upon wheelchairs for their mobility.

Little has been done to overcome this problem. While there are numerous devices which are designed for attachment to and in some cases carrying by a wheelchair to enable standing or walking by the wheelchair user, these apparatus incorporate the chair as part of the overall walker assembly. Thus, such walker assemblies have width dimensions which are at least as great as the wheelchair, and sometimes greater. Examples of U.S. Patents directed to such wheelchair walkers are U.S. Pat. Nos. 3,999,778, 3,719,390, 3,584,890, 3,405,954, 3,398,974 and 2,596,055.

At least one attempt has been made to provide a wheelchair which is adaptable for movement through relatively narrow passageways. Such apparatus is disclosed in U.S. Pat. No. 4,098,521. This patent discloses a wheelchair which can be converted to a narrow attendant-propelled wheelchair by removal of the main drive wheels. While this may be an acceptable approach for many applications, it has disadvantages that limit its usefulness.

OBJECTS AND SUMMARY OF INVENTION

A. Objects of the Invention

It is an object of the present invention to provide a transfer stool for a wheelchair or the like that can be carried by the wheelchair in a collapsed compact condition and readily deployed by the user of the chair without assistance to provide a rolling, narrow width stool permitting passage through narrow openings.

Another object of the present invention is to provide a wheelchair-carried transfer stool which may be easily mounted and demounted from the wheelchair without the need for assistance by an attendant.

Still a further object of the present invention is to provide a wheelchair-carried transfer stool which can be compactly mounted to the wheelchair and provides an armrest structure for the wheelchair.

Still a further object of the present invention is to provide a wheelchair-carried transfer stool in which the disabled person can transfer from the chair to the stool in a safe and relatively easy manner.

Still a further object of the present invention is to provide a wheelchair-carried transfer stool which is formed for relatively easy mounting to a wide variety of conventional wheelchairs.

Another object of the present invention is to provide a wheelchair-carried transfer stool which is compact, durable, safe in use and operation, has a minimum number of parts, and can be easily and inexpensively manufactured.

The wheelchair-carried transfer stool of the present invention has other objects and features of advantage which are described in more detail in and will become apparent from the accompanying drawing and the description of the preferred embodiment.

B. Summary of the Invention

The wheelchair-carried transfer stool of the present invention is comprised, briefly, of a seat portion, leg means secured to the seat portion and formed for movement to and from a collapsed condition and an extended condition, with the leg means and seat portion being formed to provide a relatively narrow width dimension when the legs are in the extended condition, wheel means rotatably mounted to the leg means, and mounting means secured to at least one of the seat portion leg means and formed for cooperative engagement with a wheelchair mount provided on the wheelchair. The mounting means is further formed for selective removal of the transfer stool from the chair and mounting of the transfer stool to the chair for carrying when the leg means is in the collapsed condition. Preferably the legs can be deployed while the stool is still mounted to the wheelchair and the transfer stool is formed with a plate-like configuration permitting mounting of the stool in a collapsed condition in a position at which a conventional armrest for the wheelchair would be located. The transfer stool may also be provided with foldable footrest means.

DESCRIPTION OF THE DRAWING

FIG. 4 is an enlarged, rear elevational view of the transfer stool of the present invention.

FIG. 5 is a side elevational view of the transfer stool of FIG. 4.

FIG. 6 is an enlarged, fragmentary, end elevational view taken substantially along the plane of line 6—6 in FIG. 1.

FIG. 7 is an enlarged, fragmentary, end elevational view taken substantially along the plane of line 7—7 in FIG. 1.

DESCRIPTION OF THE PREFERRED EMBODIMENT

Figure 1:
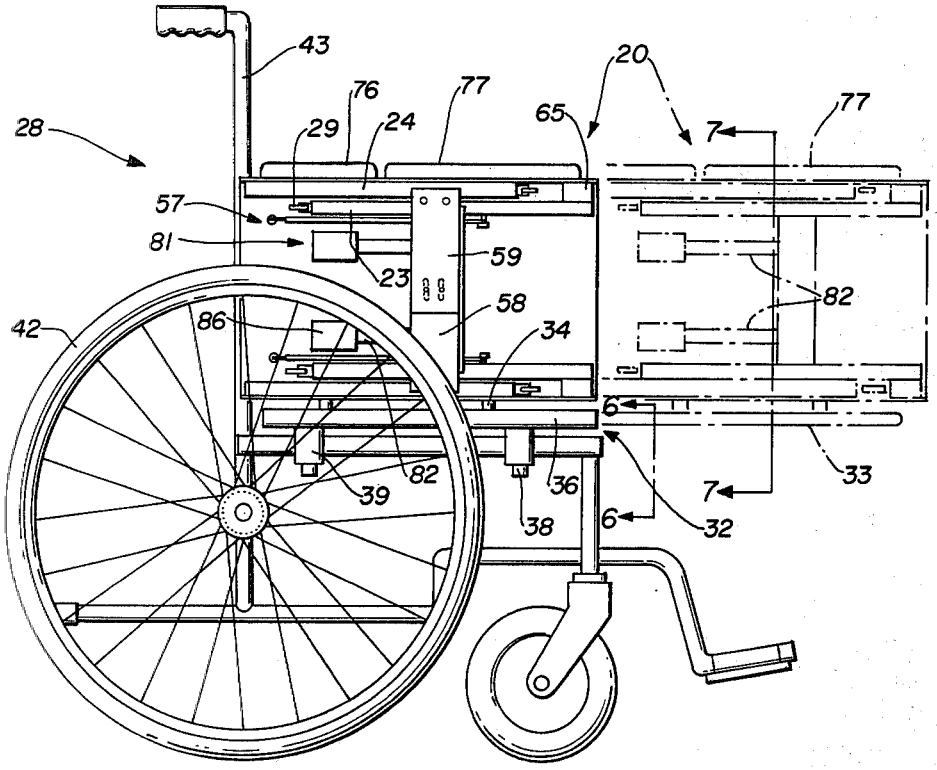
FIG. 1 is a side elevational view of a wheelchair and transfer stool constructed in accordance with the present invention, with the transfer stool shown in phantom in a moved position.
Figure 2:
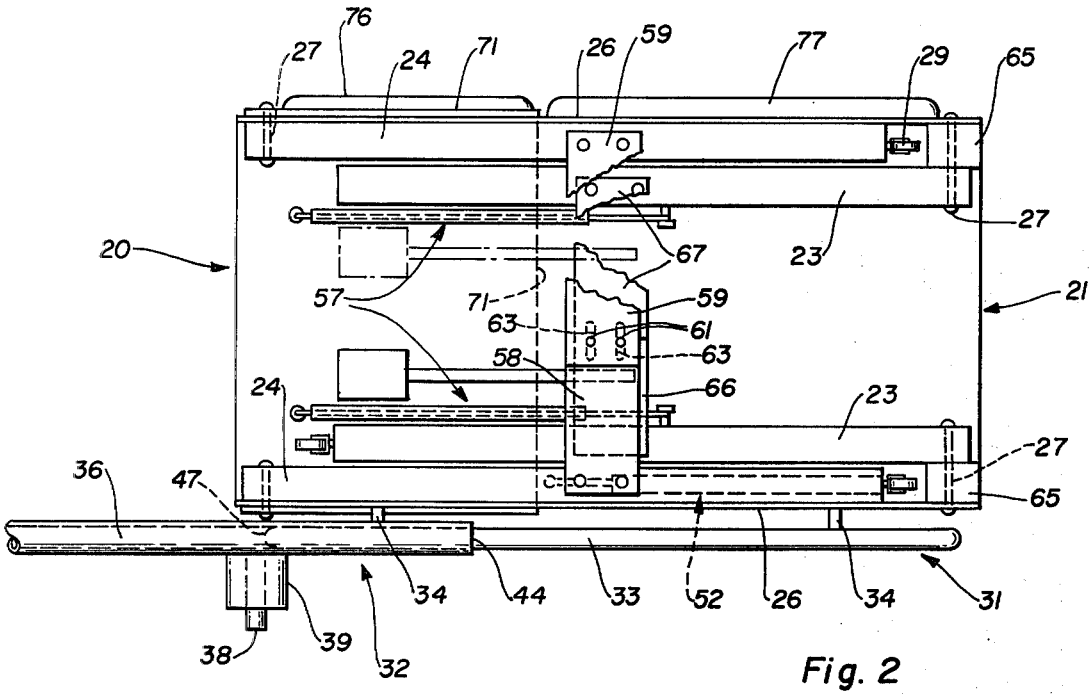
FIG. 2 is an enlarged side elevational view, partially broken away, of the transfer stool in the position shown in phantom in FIG. 1.

The wheelchair-carried transfer stool of the present invention is basically formed with a stool-like structure in which there is a seat portion, generally designated 21, to which leg means, generally designated 22, is secured. Leg means 22 is formed for movement to and from a collapsed condition (shown in FIGS. 1, 2 and 7) and an extended condition (shown in FIGS. 3, 4 and 5). Leg means 22 is preferably provided by a pair of front legs 23 and a pair of rear legs 24, which are pinned to downwardly depending side flanges 26 of seat 21 by pivot pins 27. As will be understood, other forms of leg means are suitable for use in the transfer stool of the present invention, as are other structures for foldably or collapsible mounting leg means 22 to seat portion 21. It is an important feature of the present invention, however, that the leg structure and seat can be moved to and from a collapsed condition in which the leg means and seat portion are in close proximity to each other to enable the transfer stool of the present invention to be easily carried by a wheelchair, such as the wheelchair, generally designated 28, shown in the drawing.

Rotatably mounted on the distal end of leg means 22 are wheel means 29, here shown as conventional casters. Casters 29 are formed to provide rolling support of transfer stool 20 when legs 23 and 24 are in the extended position of FIGS. 3–5.

In order to mount transfer stool 20 to wheelchair 28 for carrying of the transfer stool by the wheelchair, the transfer stool of the present invention further includes mounting means, generally designated 31, secured to at least one of seat portions 21 and leg means 22 and formed for cooperative engagement with a wheelchair mount, generally designated 32, provided on wheelchair 28. Mounting means 31 is preferably formed as an elongated rod-like member 33 secured by spacer elements 34 to one of seat flanges 26. The rod-like mounting member 33 preferably extends substantially along the entire length of one side of transfer stool 20, with at least two spacer elements 34 being employed to secure the mounting rod 33 to side flange 26 of the seat.

Wheelchair mount 32 is preferably formed as an elongated tube 36 having a longitudinally extending slot 37 therein dimensioned for receipt of spacer elements 34 (see FIG. 6). Tube 36 is mounted on at least two posts 38, which in turn are received in sockets 39 attached to wheelchair frame member 41. The sockets 39 are conventionally provided on wheelchairs for mounting of the armrest structure to the chair. Accordingly, the wheelchair mount 32 includes sockets 39, slotted tube 36 and posts 38, secured to tube 36 at spaced locations corresponding to the spacing between sockets 39.

As thus formed, the transfer stool mounting means 31 can be used to selectively removably mount transfer stool 20 to wheelchair 28 for carrying of the transfer stool by the wheelchair in a stored position when leg means 22 is in the collapsed condition. As best may be seen in FIG. 1, the transfer stool is carried by the mounting means in essentially the same location as would be a conventional armrest. The collapsible leg structure of the transfer stool and the transfer stool mounting means enable carrying of the transfer stool between the drive wheel 42 and frame for back 43 of the wheelchair.

Figure 3:
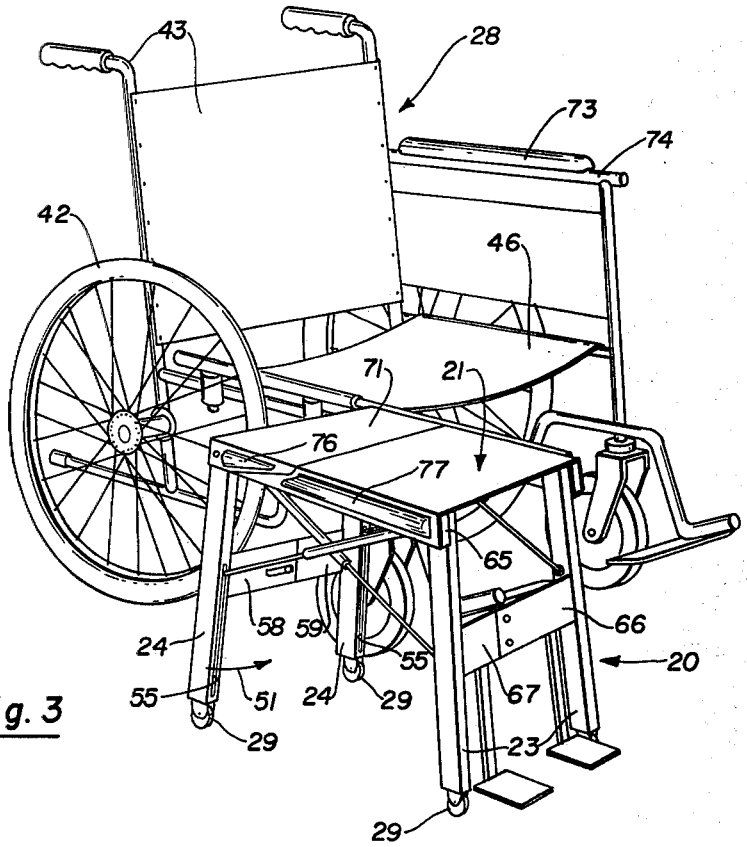
FIG. 3 is a top perspective view of the wheelchair-carried transfer stool of the present invention shown in a deployed position.

Before describing in detail the construction of the collapsible leg means of the transfer stool of the present invention, the steps in mounting the transfer stool to the wheelchair and removing the same from the chair can be set forth. As is shown in solid lines in FIG. 1, transfer stool 20 is in a collapsed condition and is mounted to the wheelchair in a stored position. The first step to deploying the transfer stool from the wheelchair is to slide the transfer stool forward to the position shown in phantom lines in FIG. 1 or solid lines in FIG. 2. Thus, the rod-like mounting member 33 slides inside wheelchair mount tube 36 to the position shown in phantom in FIG. 1 and in solid lines in FIG. 2. As soon as the rearmost spacer 34 clears the end 44 of wheelchair mount tube 36, the mounting rod 33 is free to rotate inside tube 36. Thus, the transfer stool can now be rotated from the position of FIG. 2 to a position at which the seat portion is horizontal, as is shown in FIG. 3. Either before or after rotation of seat portion 21 to a horizontal position, the legs of the transfer stool can be extended. As shown in the drawing, the rear legs 24 should be lowered first, and then the front legs can be lowered to the fully extended condition.

As will be seen from FIG. 3, transfer stool 20 is now deployed immediately adjacent the seat 46 of the wheelchair. Additionally, with the transfer stool in the deployed position of FIG. 3, there is no arm structure between seat 46 and the transfer stool. This makes it relatively easy and safe for a disabled person to slide from seat 46 onto seat 21 of the transfer stool. Moreover, this can be accomplished while the end 47 of mounting rod 33 is still inside wheelchair mount tube 36 so that the transfer stool is not free to slide away from the wheelchair while the disabled patient is sliding from seat 46 to stool 21.

As will be apparent, it is also possible to deploy the transfer stool by simply sliding the same forwardly until the rod 33 is completely untelescoped from tube 36. The transfer stool is then free of the mount and the wheelchair and can be manipulated by hand by the disabled person while he sits in the chair. Thus, the legs can be extended and the stool positioned directly in front of the disabled person to enable sliding from chair seat 46 onto stool 20 with the legs straddling seat 21. The best technique for deploying the transfer stool depends to some degree upon the type of disability of the person using the chair and his preference as to transfer from the chair to the stool.

Since one of the primary purposes of providing the transfer stool is to enable access through relatively narrow passageways, openings and the like, the transfer stool of the present invention has a relatively narrow width dimension W (FIG. 4) as compared to wheelchair 28. A conventional wheelchair will have a width of about 66 centimeters (26 inches). The transfer stool of the present invention preferably has a width dimension W when the legs are in the extended condition of about 30.5 centimeters (12 inches) or less. The length of the transfer stool is preferably about 48 centimeters (19 inches) which enables the stool to be maneuvered in tight passageways. In this regard, the casters 29 are rotatable about a vertical axis in a conventional manner to enable turning of the transfer stool, as well as rolling support on a surface. Thus, it is preferable that the transfer stool of the present invention have a relatively narrow width dimension and preferably a width dimension of no more than about one-half of that of wheelchair 28. Additionally, the transfer stool of the present invention preferably has a relatively narrow thickness dimension T (FIG. 7) when the legs and seat are in the collapsed condition. The transfer stool preferably has a thickness dimension T about equal to a conventional wheelchair armrest, namely, about eight centimeters (three inches) or less.

Although there are several possible folding leg structures which are suitable for use with the transfer stool of the present invention, the structure shown in the drawing which will produce a relatively narrow thickness dimension T can be set forth in detail. Rear legs 24 are pinned for pivotal movement in the direction of arrow 51 by a pivot pin 27 passing through side flange 26 of the stool. In order to limit the movement of legs 24, leg-retaining means 52 is provided. Retaining means 52 is comprised of a rod-like member 53 secured at 54 to rear legs 24 and telescoped inside tubular member 56, which is secured to the underside of seat 21. Member 53 has an enlarged end which passes into tube 56 and limits the outward telescoping of the rod and tube and therefore the outward pivoting of legs 24. Similar retaining means, generally designated 57, are provided for front legs 23.

The retaining structure 57 can be mounted to the sides of front legs 23, while retaining structure 52 for the rear legs is mounted to the middle of the rear legs and collapses into a slot 55 provided in the rear legs.

In order to cross-brace the legs against undesirable lateral displacement, rear legs 24 are provided with a pair of lateral brace elements 58 and 59, which overlap each other. Pins 61 are provided in plate 59 and extend inwardly into laterally extending slots 63 in plate 58. When in the collapsed condition, pins 61 are in the middle of slots 63, while pins 61 are at the ends of slots 63 in the extended condition, as best may be seen in FIG. 4.

Front legs 23 are mounted to spacer blocks 65 by pivot pins 27 and are similarly formed with cross-bracing members 66 and 67.

Thus, the front legs can be folded first against the underneath side of the seat 21. The restraining means 57 will telescope along the sides of front legs 23 and the pins in the cross-bracing members 66 and 67 will slide along the slots provided. The rear legs can then be folded up against the underneath side of the seat structure with restraining means 52 collapsing into slot 55 in the rear legs. The rear legs fold to a position between the front legs and the side flanges 26 of the seat. The pins 61 slide in slots 63 as the cross-bracing members 58 and 59 are urged towards each other.

It will be noted that overlapping of cross-bracing structures for the front and rear legs limits, to a minor degree, the closeness with which the front and rear legs can be nested against the underside of the seat. This can be overcome by recessing the cross-bracing structure for the front legs or moving the bracing structures so that they do not overlap, although the amount to which nesting is limited is only the thickness of the cross-bracing members, which are relatively thin.

In order to provide a footrest means, generally designated 81, on transfer stool 20, a pair of square tubular members 82 are preferably secured to cross-bracing members 66 and 67. Hingedly mounted by hinge means 83 to the distal ends 84 of tubes 82 are foot support plates 86, which are movable between a folded and a deployed position. As will be seen, the rearmost portion 87 of the foot support plates will engage ends 84 to limit pivotal movement of the footrests. Tubes 82 are secured, for example by welding, to the back side of cross-bracing members 66 and 67 so that they will not interfere with the nesting of the legs in the collapsed condition.

The footrest structure can be provided with detent or latch means (not shown) to retain the foot plates in the folded condition, and similarly the entire leg means can be latched or releasably secured in the collapsed condition.

It is further preferable that seat portion 21 be provided with a back 71 that can be foldably mounted to the remainder of the seat portion by pivot pins 27 used to secure the rear legs to the seat portion. In FIG. 3, the back 71 is shown in a collapsed condition; however, in FIGS. 4 and 5 it is shown in a deployed position. It will be noted that, depending upon the location of spacer elements 34 and the height of the sides of back 71, a slot or notch 72 should be provided in the side of back 71 on which mounting rod 33 is affixed. It should also be noted that the timing of raising back 71 during the deployment of the transfer stool of the present invention can also be varied in accordance with the preference of the user of the transfer stool. For some, it will be easier to slide onto the stool with the back down and thereafter raise the back. Others may prefer to raise the back before moving onto the stool.

It is a further feature of the present invention to provide the transfer stool with armrest means corresponding to the padded armrest 73 on wheelchair armrest 74. Since the transfer stool is carried in the position of a conventional armrest, armrest means in a form of a cushion element 76 mounted to back 71 and a second cushion element 77 mounted to the side flange 26 on the opposite side of the stool from the mounting rod 33 may be employed. The cushions 76 and 77 will therefore be positioned at substantially the same height as the cushion 73 on the opposite arm of the wheelchair.

The transfer stool of the present invention can be mounted to powered or unpowered wheelchairs and should be formed of lightweight, but sturdy materials of a type conventionally employed in connection with wheelchairs. The relatively small size of the chair and its formation of lightweight materials, such as aluminum, enhance the stool's overall mobility. Although not shown in the drawings, it is contemplated that the legs of transfer stool 20 can also be provided as relatively telescoped members. These telescoped legs can be coupled together by a rack and worm gear structure and driven by small battery-powered motors to enable the transfer stool to further have a height which can be selectively adjusted by control means operated by the disabled person. The ability to adjust the height of seat portion 21 adds further to the overall versatility of the wheelchair-carried transfer stool of the present invention.

What is claimed is:

1. A transfer stool attachable to a wheelchair comprising:

a seat portion;

leg means secured to said seat portion and formed for movement to and from a collapsed condition at which said leg means and seat portion are in close compact proximity to each other and an extended condition at which said leg means is extended for support of an individual sitting on said seat portion, said leg means and seat portion being further formed to provide a relatively narrow width dimension when said leg means is in said extended condition;

wheel means rotatably mounted to said leg means for rolling support of said stool when said leg means is in said extended condition; and mounting means secured to at least one of said seat portion and said leg means and formed for cooperative engagement with a wheelchair mount provided on a wheelchair, said mounting means being further formed for selective removable mounting of said transfer stool to said wheelchair mount for carrying of said transfer stool by said wheelchair when said leg means is in said collapsed condition, said mounting means mounting the collapsed stool on said wheelchair in the position of an armrest.

2. A wheelchair transfer stool as defined in claim 1 wherein, said mounting means is formed for movement of said transfer stool to and from a stored position and a deployed position while still attached to said wheelchair, said mounting means and said leg means being further formed for movement of said leg means to and from said extended condition when said transfer stool is in said deployed position.

3. A wheelchair transfer stool as defined in claim 2 wherein, said mounting means is formed for transfer of the individual using said wheelchair to and from said wheelchair and said transfer stool when said transfer stool is in said deployed position and attached to said wheelchair.

4. A wheelchair transfer stool as defined in claim 1 wherein, said seat portion and said leg means are formed for collapsing of said transfer stool to a plate-like configuration having a relatively narrow thickness dimension when in said collapsed condition, and said mounting means is secured to a side of said seat portion and formed for cooperative engagement with said wheelchair mount and for positioning of said transfer stool in said collapsed condition in said stored position with said transfer stool in a substantially vertical orientation.

5. A wheelchair and a transfer stool, said transfer stool including a seat, a plurality of legs movably secured to said seat for movement to and from a collapsed condition and an extended condition, and wheel means secured to said legs for rolling support of said transfer stool, wherein the improvement in said wheelchair and said transfer stool comprises:

(a) said wheelchair being formed with a wheelchair mount; and (b) said transfer stool being formed with mounting means formed for cooperative engagement with said wheelchair mount and for removable mounting of said transfer stool to said wheelchair mount for carrying of said transfer stool by said wheelchair in a stored position when said transfer stool is in said collapsed condition, said mounting means mounting the collapsed stool on said wheelchair in the position of an armrest.

6. A wheelchair and transfer stool as defined in claim 5 wherein, said seat and said legs are formed to provide a relatively narrow width dimension when said legs are in said extended condition.

7. A wheelchair and transfer stool as defined in claim 6 wherein, said seat and said legs are formed for collapsing of said transfer stool to a plate-like configuration having a relatively narrow thickness dimension in said collapsed condition.

8. A wheelchair and transfer stool as defined in claim 7 wherein, said wheelchair is formed with arm mounting sockets and said wheelchair mount is formed for and mounted to said wheelchair in said sockets; and said mounting means is formed for cooperative engagement with said wheelchair mount to secure said transfer stool to said wheelchair mount in a substantially vertical orientation along a side of said wheelchair proximate a position at which a wheelchair arm would be located.

9. A wheelchair and transfer stool as defined in claim 8 wherein, said transfer stool is further formed with armrest means extending along a side of said seat and positioned for support of the arm of the user of said wheelchair when said transfer stool is in said stored position.

10. A wheelchair and transfer stool as defined in claim 5 wherein, said wheelchair mount and said mounting means are formed for movement of said transfer stool to and from said stored position and a deployed position while still attached to said wheelchair, said wheelchair mount and said mounting means and said legs being further formed for movement of said legs to and from said extended condition when said transfer stool is in said deployed position.

11. A wheelchair and transfer stool as defined in claim 5, and footrest means mounted to said transfer stool for movement to and from a collapsed condition and an extended condition.

12. A wheelchair and transfer stool as defined in claim 11 wherein, said footrest means is secured to said legs and includes a foot support plate pivotally mounted to the remainder of said footrest means for selective movement to and from a folded position and a deployed position.

13. A wheelchair and transfer stool as defined in claim 5, and seat back means pivotally mounted to said seat of said transfer stool for selective movement to and from a position for support of the back of a user and a position closely proximate said seat.

* * * * *